United States Patent [19]

Tolley

[11] 4,175,110

[45] Nov. 20, 1979

[54] RECOVERY OF TITANIUM METAL VALUES

[75] Inventor: William K. Tolley, Arlington Heights, Ill.

[73] Assignee: UOP Inc., Des Plaines, Ill.

[21] Appl. No.: 935,812

[22] Filed: Aug. 22, 1978

[51] Int. Cl.[2] ..... C01G 23/04

[52] U.S. Cl. ..... 423/83; 423/69; 423/82; 423/85; 423/140; 423/141; 423/150; 75/114

[58] Field of Search ..... 423/69, 82, 83, 85, 423/140, 141; 75/1 T, 101 R, 114

[56] References Cited

U.S. PATENT DOCUMENTS

| | | | |
|---|---|---|---|
| 3,076,692 | 2/1963 | Ruter et al. | 423/83 |
| 3,236,596 | 2/1966 | Zumgibl et al. | 423/83 |
| 3,825,419 | 7/1974 | Chen | 75/101 R |
| 3,859,077 | 1/1975 | Othmer | 75/1 T |
| 3,903,239 | 9/1975 | Berkovich | 423/82 |
| 3,929,962 | 12/1975 | Shiah | 423/83 |

*Primary Examiner*—Herbert T. Carter

*Attorney, Agent, or Firm*—James R. Hoatson, Jr.; Raymond H. Nelson; William H. Page, II

[57] ABSTRACT

Titanium metal values are recovered from a titanium bearing source such as an ilmenite ore by subjecting the source to a reductive roast and leaching the reduced source with a halogen-containing compound. Following this the soluble metal halides are separated from gangue and the pregnant leach liquor if treated with an iron oxide such as ferric oxide to precipitate titanium dioxide. The nucleation of the titanium dioxide may be improved by using a large excess of ferric oxide in the precipitation step. The improvement will thus result in an increased yield of the desired titanium dioxide.

5 Claims, No Drawings

RECOVERY OF TITANIUM METAL VALUES

BACKGROUND OF THE INVENTION

Titanium in metallic form or as a compound is an important element in the chemical series. For example, titanium dioxide is utilized in paint pigments, in white rubbers and plastics, floor coverings, glassware and ceramics, painting inks, as an opacifying agent in papers, etc. The other titanium compounds are used in electronics, as fire retardants, waterproofing agents, etc. The metal may be used as such or in alloy form as structural material in aircraft, in jet engines, marine equipment, textile machinery, surgical instruments, orthopedic appliances, sporting equipment, food handling equipment etc. Heretofore in recovering the titanium from titanium bearing sources such as ilmenite, rutile, etc., the titanium has been subjected to separation steps which involve the formation of titanium as a compound in a valence state of +4, such compounds usually involving titanium oxide. However, when attempting to separate titanium dioxide from impurities which are also contained in the ore such as iron, the hydrolysis of the titanium dioxide at elevated temperatures usually results in also obtaining relatively large amounts of iron along with the titanium.

Heretofore in the prior art various methods have been utilized to recover titanium values from titanium bearing sources. For example, in U.S. Pat. No. 3,236,596 an unroasted ilmenite ore is leached with hydrogen chloride at an elevated temperature. Following this, dissolved iron is reduced with iron or other reductants to precipitate ferrous chloride by saturating the liquor with hydrogen chloride gas. The hydrogen chloride is then extracted from the liquor by a vacuum distillation and the titanium is recovered by conventional means. Likewise, U.S. Pat. No. 3,825,419 reduces an ilmenite ore to produce ferrous oxides. The reduced ore is then leached for about 4 hours under a moderate pressure thereby dissolving the iron in the acid along with about 15% of the titanium. The iron is recovered as ferric oxide containing impurities in the spray roaster while the insoluble product which is primarily titanium dioxide but which contains all of the silica present in the original ore is recovered. U.S. Pat. No. 3,859,077 also discloses a process for recovering titanium in which a titanium tetrahalide is mixed with iron oxide in slag or a titaniferous ore at an extremely high temperature of about 1000° C. to produce volatile impurity chlorides and titanium dioxide. A similar patent, U.S. Pat. No. 3,929,962, also reduces a titanium bearing ore at a high temperature to produce titanium sesquioxide which is in a form whereby it is easier to treat for a titanium-iron separation. Another prior art reference, U.S. Pat. No. 3,903,239 teaches a method for recovering titanium in which unroasted ilmenite is leached over a period of days at room temperature to recover about 80% of the titanium. Sulfur dioxide is added during the leaching to cause a precipitation of the ferrous chloride after which titanium dioxide is recovered by diluting and heating the solution.

As will hereinafter be shown in greater detail, it has now been discovered that improved yields of titanium dioxide may be obtained by treating titanium halides in a preferred manner.

This invention relates to a process for obtaining excellent yields of titanium compounds such as titanium dioxide. More specifically, the invention is concerned with a process for recovering economical yields of titanium metal values from a titanium bearing source as ilmenite. By utilizing the process of the present invention, it will be possible to obtain an excellent yield of titanium metal values using relatively low grade ores as the starting material.

It is therefore an object of this invention to provide an improved process for the production of titanium metal values.

A further object of this invention is to provide a hydrometallurgical process for obtaining high yields of titanium metal values in the form of rutile from titanium bearing sources such as ilmenite.

In one aspect an embodiment of this invention resides in a process for producing titanium metal values from a titanium bearing source which comprises the steps of crushing said titanium bearing source, subjecting said crushed source to a reductive roast at an elevated temperature in a reducing medium, leaching the reduced source with a leach solution comprising a halogen-containing compound, separating insoluble material from the pregnant leach liquor containing titanium halides, treating the leach liquor to precipitate titanium dioxide, and recovering said titanium dioxide, the improvement which comprises treating said leach liquor with an excess of ferric oxide while maintaining the solution in an agitated condition.

A specific embodiment of this invention resides in a process for producing titanium metal values from ilmenite which comprises crushing said ilmenite to a desired particle size, subjecting the crushed ilmenite to a reductive roast at a temperature in the range of from about 600° to about 1000° C., in a reducing medium comprising a mixture of carbon monoxide and hydrogen, leaching the reduced source with an aqueous hydrogen chloride solution, separating insoluble material from the pregnant leach liquor, cooling said leach liquor to precipitate ferrous chloride and separating the ferrous chloride from the leach liquor, treating the leach liquor with an excess of ferric oxide in a range of from about 2.5 to about 50 times the stoichiometric amount required to react with the titanium chloride, removing the solids which are formed by the ferric oxide treatment, admixing the solids with a second leach solution to consume the remaining ferric oxide, and recovering the desired titanium dioxide.

Other objects and embodiments will be found in the following further detailed description of the present invention.

As hereinbefore set forth the present invention is concerned with a process for preparing readily obtainable rutile from a leach liquor containing soluble titanium halides. The process for obtaining the desired titanium metal values is effected by crushing an ore source such as ilmenite or other sources such as sand which contains the desired metals, chiefly titanium, as well as amounts of other metals such as iron, vanadium, chromium, manganese, etc., to a particle size which is less than about 35 mesh. Thereafter the crushed metal bearing source is subjected to a reductive roast at an elevated temperature which will range from about 600° up to about 1000° C. or more and preferably in a range of from about 600° to about 900° C. in the presence of a reducing gas such as hydrogen, carbon monoxide, combinations of carbon monoxide and hydrogen, etc., or any other suitable reductant. The reductive roast is effected for a period of time ranging from about 0.5 up to about 2 hours or more. In the preferred embodiment of the invention, the reducing atmosphere which is used to accomplish the purpose of the roast usually comprises a mixture of about 50% carbon monoxide and 50% hydrogen, with an excess of reductant being utilized in order to completely reduce the iron which is present in the system to the metal. It is also contemplated within the scope of this invention that the crushed ore may be, if so desired, subjected to an oxidation roast prior to the reductive roast, said oxidative roast being accomplished at a temperature in the range of from about 600° to about 900° C. in the presence of an oxidizing atmosphere which is provided for by the presence of air or oxygen. However, it is to be understood that this step is not a necessary part of the present invention. Following the reductive roast of the metal bearing source, the source is then subjected to an aqueous hydrogen halide leach which, in the preferred embodiment of the invention, comprises an aqueous hydrogen chloride leach although other hydrogen halides such as hydrogen bromide and hydrogen iodide may also be utilized although not necessarily with equivalent results. The aforesaid leach of the metal bearing source is usually effected at a temperature which may range from about ambient up to about 110° C., the preferred range being from about 80° to about 100° C., for a period of time ranging from about 0.25 hours up to about 1 hour or more in duration.

Following the leach of the metal bearing source which will form soluble iron halides and titanium halides such as ferrous chloride, titanium trichloride, etc., the mixture is subjected to a separation step in which the solid gangue is separated from the soluble metal chlorides and discarded. The separation of the solid gangue from the soluble metal chlorides may be effected in any suitable manner by means well known in the art, said means including decantation, filtration, etc.

In one embodiment of the process the soluble metal halides may then be cooled to a temperature sufficient to effect the crystallization or precipitation of the ferrous chloride. For example, the temperature at which the crystallization or precipitation of the ferrous chloride is effected may range from about 0° to slightly in excess of ambient or as high as 90° C. in extreme cases. When using subambient temperatures, the cooled solution is maintained in the subambient range by external means such as an ice bath, cooling coils, etc. After crystallization of the ferrous chloride is completed, the solids are separated from the dissolved titanium chloride such as titanium trichloride by conventional means such as filtration, decantation, etc.

The desired titanium dioxide in the form of rutile is obtained by treating the remaining leach solution containing aqueous titanium trichloride with a metal oxide, and preferably an iron oxide such as ferric oxide at a temperature in the range of from about 70° C. to about 100° C. The latter compound may be obtained by oxidizing the solid ferrous chloride which has been separated and recovered from the leach solution in any manner known in the art. For example, the ferrous chloride may be oxidized at temperatures ranging from about 300° to about 800° C. in contact with an oxygen-containing gas such as air or oxygen whereby the ferrous chloride is converted to ferrous oxide and ferric oxide, the latter compound being the predominant form of the iron oxide. The treatment of the leach solution containing titanium trichloride to nucleate the hydrolysis reaction is effected by adding the iron oxide material to the leach solution. In order to obtain an effective nucleation of the rutile, it has now been discovered that the amount of ferric oxide which is used should be in a large excess, and is preferably present in an amount in a range of from about 2.5 to about 50 times the stoichiometric amount which is required to react with the titanium halide such as titanium trichloride. The large excess is added to the loaded leach liquor while maintaining the solution in an agitated state.

After allowing the reaction to proceed for a period of time which may range from about 1 to about 10 minutes or more in duration, the solids which are formed are removed from the solution and thereafter admixed with a second leach solution which contains a sufficient amount of titanium halide to completely react with the iron oxide which remains in the solids. The reaction of the ferric oxide with the titanium compound is effected at elevated temperatures which may range from about 70° to about 100° C. or more and preferably in a range of from about 75° to about 95° C. Following the second reaction the solids may then be recovered by separation from the spent leach liquor which contains ferrous chloride and recovered by conventional means or, if so desired, the titanium dioxide may be further treated to recover titanium metal.

If so desired, the process may also be effected in a different manner by treating the pregnant leach liquor containing the soluble metal halides which have been separated from the insoluble gangue material using an excess of ferric oxide in an amount hereinbefore set forth in greater detail. Following the nucleation and precipitation of the titanium compound in two stages as hereinbefore described, the solids which comprise titanium dioxide are then separated from the liquid. Following the separation, the liquid is then cooled to a temperature within the range hereinbefore set forth to effect crystallization of the ferrous chloride. The solid ferrous chloride may then be treated in either a direct reduction step to form metallic iron and hydrogen chloride or, if so desired, it may be subjected to an oxidation step by treatment with air or other oxygen-containing gases at a temperature in the range of from 300° to about 800° C. to form ferric oxide. This ferric oxide may then be recycled back to the step wherein the pregnant leach liquor is contacted with the excess ferric oxide to form the desired titanium dioxide.

The process of the present invention may be effected in any suitable manner and may comprise either a batch or continuous type operation. For example, in one embodiment of the process when a batch type operation is to be employed, the titanium bearing source which has been crushed or ground to the desired particle size, usually in a range of from about −35 to about −100 mesh, is placed in an apparatus such as an oven wherein it is roasted at a temperature within the range hereinbefore set forth while subjecting the ore to a reducing atmosphere such as a mixture of carbon monoxide and hydrogen. Upon completion of the reductive roast the crushed ore is then placed in a second vessel wherein it is subjected to a leaching operation by contact with an aqueous hydrogen halide such as concentrated hydrochloric acid while maintaining the temperature in a range of from about 80° to about 105° C. Upon completion of the desired leaching operation, the solid material such as gangue and/or insoluble metal compounds are separated from the pregnant leach liquor which is then recovered. One method of treating the pregnant leach liquor is to then place said leach liquor in a flask or other such apparatus which is then cooled or is maintained at a relatively cool temperature in order to crystallize out the ferrous chloride. After precipitation of the ferrous chloride the leach liquor containing the soluble titanium chloride is separated from the solid ferrous chloride by conventional means such as filtration, centrifugation, etc., and placed in yet another apparatus where it is contacted with an excess of ferric oxide in the order of magnitude hereinbefore set forth. The apparatus which is utilized for the ferric oxide treatment will contain heating means as well as agitation means whereby the mixture may be agitated by means of mechanical stirrers or other means in order to maintain the solution in an agitated state during the nucleation period which may range from about 1 to about 10 minutes or more in duration. Upon completion of the desired nucleation period and with the attendant formation of titanium dioxide, the solids are separated and contacted with a second amount of leach liquor containing titanium chloride in order to consume the remaining amount of ferric oxide which is present. Thereafter the solid titanium dioxide is separated from the soluble iron chloride which has been formed by the reaction and recovered.

Alternatively, if so desired, the pregnant leach liquor after recovery following separation from the insoluble gangue may be treated at an elevated temperature with ferric oxide prior to removal of the ferrous chloride which is present in the leach liquor along with the titanium chloride. After treating the leach liquor with the excess ferric oxide in a manner similar to that hereinbefore set forth the solid titanium dioxide is recovered while the soluble ferrous chloride originally present in the leach liquor and the additional ferrous chloride which is formed by the reaction between ferric oxide and titanium chloride may then be precipitated by cooling the liquor to form solid ferrous chloride. The ferrous chloride may then be treated in either a reduction step or an oxidation step. If the former step is effected, that is, the direct reduction of ferrous chloride by treatment with hydrogen at an elevated temperature, the resulting metallic iron which is formed may be recovered while any hydrogen chloride may be recycled to the leach liquor. Alternatively, as the ferrous chloride is subjected to an oxidation step by treatment with oxygen or an oxygen-containing gas at an elevated temperature the ferric oxide which is formed thereby may be recycled to the titanium dioxide recovery step, said ferric oxide acting as the nucleation reagent.

It is also contemplated within the scope of this invention that the process may be effected in a continuous manner of operation. When such a type of operation is used, the ore which has been crushed or ground to the desired particle size is passed through an apparatus such as an oven at a predetermined rate of speed while being subjected to the action of a reducing atmosphere such as hydrogen or a combination of carbon monoxide and hydrogen while maintaining the temperature of the oven in a range of from about 600° to about 1000° C. After completing the passage through the oven, the reduced ore is continuously charged to a leaching zone wherein it is contacted with an aqueous leach solution comprising a hydrogen halide, such as hydrogen chloride, and after passage through the leaching zone which is maintained at an elevated temperature within the range hereinbefore set forth, the solution containing the soluble metal chloride such as iron chloride and titanium chloride is separated from the solid gangue material. In one embodiment the pregnant leach liquor is then continuously charged to a crystallization zone which is maintained at a lower temperature to facilitate the precipitation or crystallization of the ferrous chloride. The leach liquor containing the soluble titanium chloride is continuously withdrawn from this zone and passed to a precipitation zone wherein it is contacted with an excess of ferric oxide while maintaining the solution in an agitated state. The solids comprising excess ferric oxide and titanium dioxide are separated from the resulting soluble ferrous chloride and contacted with a second leach liquor containing soluble titanium chloride in order to consume the aforesaid excess ferric oxide. The solids which result from this second treatment and which comprise titanium dioxide are recovered and treated in a conventional manner. The ferrous chloride which has been separated from the leach liquid may, if so desired, be passed to an oxidation zone wherein it is contacted with an oxygen-containing gas at an elevated temperature of from about 300+ to about 800° C. to form ferric oxide, this compound then being used to treat the leach liquor containing the soluble titanium chloride, while the hydrogen chloride which is formed during the oxidation reaction is recycled to the leach zone to form a portion of the leaching solution charge stock.

Alternatively, the pregnant leach liquor which has been separated from the solid gangue material may be treated with ferric oxide before the ferrous chloride has been precipitated out. The contact with the ferric oxide is in a manner similar to that previously described following which the solid titanium dioxide which is formed is continuously withdrawn and recovered. While the soluble ferrous chloride solution which, at this point, contains an added amount of ferrous chloride due to the formation of the same during the precipitation of titanium dioxide, is crystallized by being continuously passed to a crystallization zone which is maintained at a lower temperature. Thereafter the solid ferrous chloride may be continuously withdrawn from this crystallization zone and treated in either a direct reduction step or an oxidation step to afford the desired metallic iron or ferric oxide if so desired.

The following example is given for purposes of illustrating the process of this invention. However, it is to be understood that this example is given merely for purposes of illustration and that the present process is not necessarily limited thereto.

EXAMPLE

A Canadian ilmenite ore was coarsely ground in a crusher to −65 mesh and was roasted for a period of 1 hour at 750° C. under a flow of 650 ml/min. each of hydrogen and carbon monoxide. At the end of this roasting time, 50 grams of the reduced ore was mixed with 300 ml of hydrochloric acid and heated to a temperature of 100° C. The ore was leached at this temperature for a period of 15 minutes following which the solution was filtered. After filtration the filtrate was cooled to room temperature to precipitate ferrous chloride. The solids which were recovered were washed and dried. Following this 100 ml of the liquid which was analyzed and found to contain 25 g/liter of iron, 49 g/liter of titanium and 0.42 g/liter of vanadium were heated to 80° C. and a large excess of ferric oxide in the amount of 26.0 grams was added while agitating the solution. The reaction was allowed to proceed for a period of 5 minutes with agitation following which the solids were recovered by filtration, washed, dried and ground to −80 mesh. Analysis of the liquid disclosed the presence of 150 g/liter of iron and only 0.12 g/liter of titanium which amounted to a 99.8% recovery of the titanium. The solids which resulted from the first reaction were then added to another 100 ml portion of the solution recovered from the ferrous chloride separation. The solution was again agitated and reacted for 5 minutes at 80° C. At the end of this period the solution was again filtered and the solids washed and dried. The solids which amounted to 12.58 grams of rutile containing minor amounts of iron, magnesium, vanadium and cobalt were recovered. It is to be noted that as hereinbefore set forth the first treatment with an excess of ferric oxide resulted in a 99.8% recovery of titanium while the second reaction of titanium dioxide containing unreacted ferric oxide with the solution containing titanium chloride resulted in a 66% recovery of titanium for an overall recovery of 84%.

A similar test in which only a slight excess of ferric oxide was added to the titanium chloride liquor in a one-stage precipitation process produced no rutile precipitate. The benefit from using this process is therefore apparent.

I claim as my invention:

1. In a process for producing titanium metal values from a titanium bearing source which comprises the steps of:

(a) crushing said titanium bearing source;

(b) subjecting said crushed source to a reductive roast at a temperature in the range of from about 600° up to about 1000° C. in the presence of a reducing medium selected from the group consisting of hydrogen gas, carbon monoxide gas, and combinations thereof;

(c) leaching said reduced source of step (b) with a hydrogen halide leach solution at a temperature in the range of from about ambient up to about 110° C. to solubilize titanium and iron halides;

(d) separating the solid gangue produced in step (c) from said soluble metal chlorides;

(e) cooling said soluble metal halides to a temperature in the range of from about 0° C. to as high as 90° C. to precipitate ferrous chloride;

(f) treating the leach liquor of step (e) after said ferrous chloride precipitation with ferric oxide at a temperature in the range of from about 70° to about 100° C. to nucleate said titanium halide to a titanium dioxide precipitate; and (g) recovering said precipitated titanium dioxide, the improvement which comprises the treatment of said leach liquor in step (f) with a stoichiometric excess of said ferric oxide in the range of from about 2.5 to about 50 times the stoichiometric amount of ferric oxide required to react with the titanium halide of said leach liquor while concomitantly maintaining said leach liquor in an agitated state, recovering solids, mixing said solids with a second leach solution containing sufficient titanium halide to consume the remaining ferric oxide and recovering the resultant titanium dioxide.

2. The process as set forth in claim 1 which the treatment of said leach liquor with ferric oxide is effected for a period of time in the range of from about 1 to about 10 minutes.

3. The process as set forth in claim 1 in which said reducing medium is hydrogen.

4. The process as set forth in claim 1 in which said reducing medium is a mixture of hydrogen and carbon monoxide.

5. The process as set forth in claim 1 in which said hydrogen halide is hydrogen chloride.

* * * * *